United States Patent [19]

Credle, Jr. et al.

[11] Patent Number: 4,836,414

[45] Date of Patent: Jun. 6, 1989

[54] PREMIX DISPENSING SYSTEM

[75] Inventors: William S. Credle, Jr., Stone Mountain; Jonathan Kirschner, Marietta, both of Ga.

[73] Assignee: The Coca-Cola Company, Atlanta, Ga.

[21] Appl. No.: 73,041

[22] Filed: Jul. 14, 1987

Related U.S. Application Data

[63] Continuation-in-part of Ser. No. 859,112, May 2, 1986, abandoned.

[51] Int. Cl.[4] ..... B67D 5/56

[52] U.S. Cl. ..... 222/1; 222/129.1; 222/146.6; 222/400.7; 137/212

[58] Field of Search ..... 222/129.1–129.4, 222/132, 144.5, 146.6, 160, 173, 182–183, 394–397, 399, 400.7, 400.8, 478, 481, 481.5, 482, 1; 137/208, 212

[56] References Cited

U.S. PATENT DOCUMENTS

| | | | |
|---|---|---|---|
| 2,018,543 | 10/1935 | Buirk | 222/397 X |
| 2,078,013 | 4/1937 | Nutry | 99/323.2 |
| 3,179,292 | 4/1965 | Terry | 222/146.6 X |
| 3,215,312 | 11/1965 | Guzzi | 222/129.1 |
| 3,233,779 | 2/1966 | Cornelius | 222/52 |
| 3,768,706 | 10/1973 | Hill | 222/325 |
| 3,822,716 | 7/1974 | Martin et al. | 137/212 |
| 3,892,335 | 7/1975 | Schroeder | 222/129.1 |
| 4,171,069 | 10/1979 | Cornelius et al. | 222/1 |
| 4,225,059 | 9/1980 | Kappos | 222/146.6 |
| 4,304,741 | 12/1981 | Avison et al. | 261/121 R |
| 4,520,950 | 6/1985 | Jeans | 222/129.1 |
| 4,526,730 | 7/1985 | Cochran et al. | 261/121 R |
| 4,534,377 | 8/1985 | Ducras | 137/212 |
| 4,555,371 | 11/1985 | Jeans | 261/122 |
| 4,564,483 | 1/1986 | Jeans | 261/64 B |
| 4,687,120 | 8/1987 | McMillin | 222/1 |

*Primary Examiner*—Michael S. Huppert

*Attorney, Agent, or Firm*—W. D. Brooks; T. R. Boston

[57] ABSTRACT

A premix dispenser system including a housing for holding three replaceable four-liter PET beverage bottles, a refrigeration system, a $CO_2$ cylinder, three adapters for connecting the $CO_2$ cylinder to the bottles for pressurizing the bottles to dispense therefrom and to maintain the carbonation thereof, and three beverage dispensing valves, for dispensing a desired quantity of cold beverage from a selected one of the bottles. The refrigeration system can be easily switched between an electrical system and a cold plate system.

14 Claims, 7 Drawing Sheets

PREMIX DISPENSING SYSTEM

CROSS-REFERENCE TO RELATED APPLICATION

This application is a continuation-in-part to copending U.S. patent application Ser. No. 859,112, filed May 2, 1986, entitled "Premix Dispensing System" by Jonathan Kirschner, and now abandoned.

BACKGROUND OF THE INVENTION

This invention relates to beverage dispensers, and in particular to a premix beverage dispenser that is inexpensive, simple, easy to operate and to maintain, and can be operated in either an electrical or a nonelectrical mode.

Beverage dispensers are well-known, particularly for post-mix operation in which a syrup is mixed with carbonated water in a valve and nozzle, for example, as shown in U.S. Pat. Nos. 4,357,284; 4,479,520; and 4,493,441.

SUMMARY OF THE INVENTION

A premix dispensing system for use with three replaceable four-liter PET beverage bottles including a $CO_2$ cylinder, an adapter for connecting the $CO_2$ cylinder to the bottles for pressurizing the bottles for dispensing therefrom and for maintaining the carbonation thereof, a refrigeration system for cooling beverage conduits extending from the bottles to dispensing valves, and three dispensing valves for dispensing the desired amount of cold beverage from a particular bottle. The adapter allows an empty bottle to be easily replaced with a new full bottle. The entire refrigeration system can be easily removed for switching between an electrical system and a cold plate system.

It is an object of the present invention to provide an inexpensive and simple to use premix beverage dispenser.

It is another object of the invention to provide a premix beverage dispenser that can be easily converted from electrical to nonelectrical operation.

It is a further object of the invention to provide a simple, inexpensive, and easy to operate adapter for connecting a $CO_2$ cylinder to a bottle, and to a dispensing valve through a cooling system.

It is another object of this invention to provide an adapter that automatically opens and closes the $CO_2$ line to the bottle as the bottle is connected thereto and disconnected therefrom, respectively.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

Figure 1:
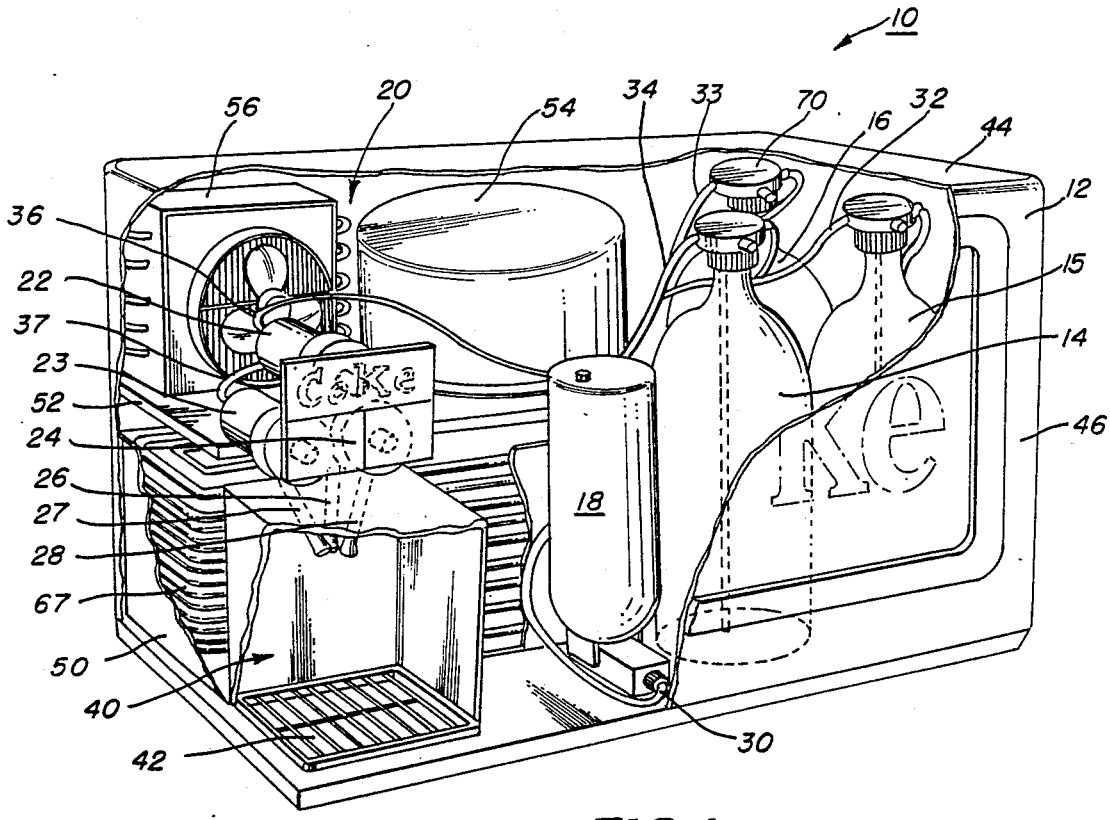
FIG. 1 is a perspective, partly-broken away, view of a premix beverage dispenser according to a preferred embodiment of the present invention.
Figure 2:
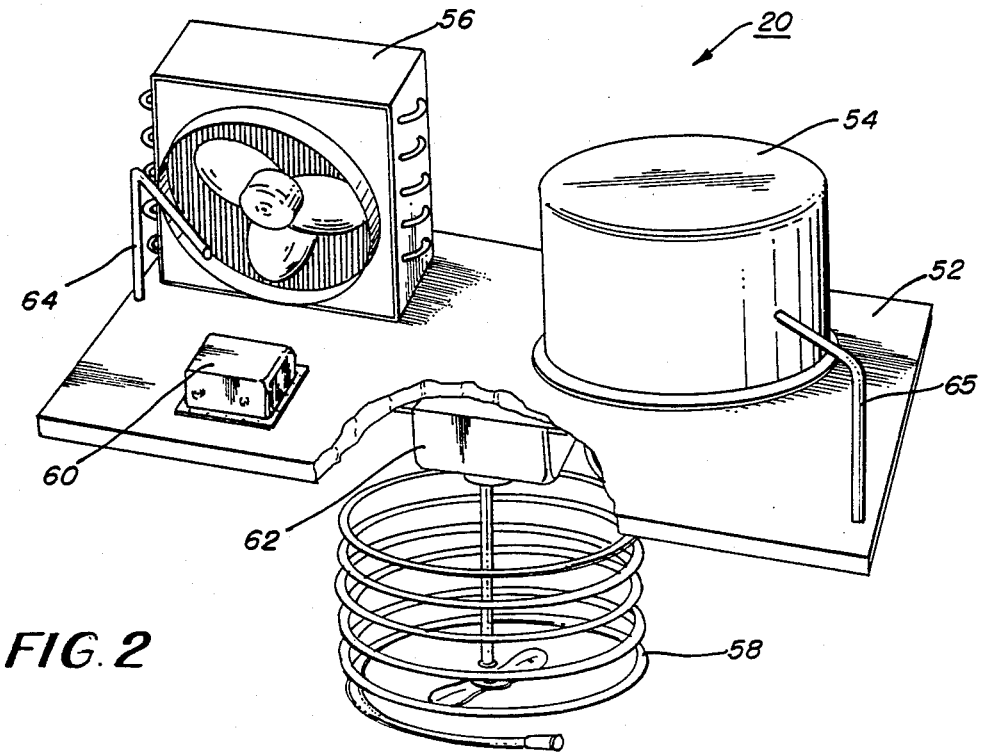
FIG. 2 is a perspective view of the refrigeration system used in the dispenser of FIG. 1.
Figure 3:
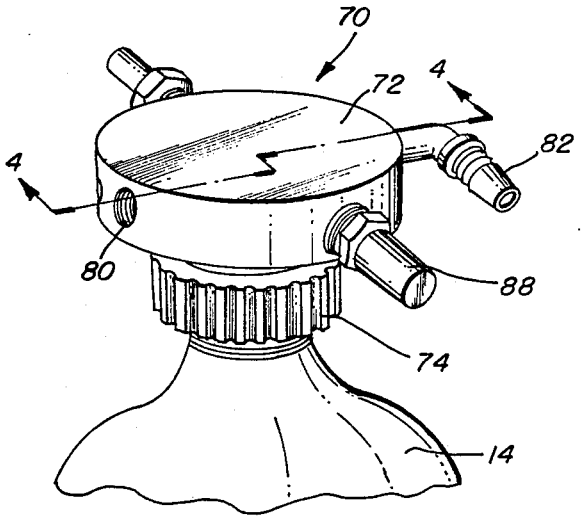
FIG. 3 is a perspective view of the bottle adapter of the present invention.
Figure 4:
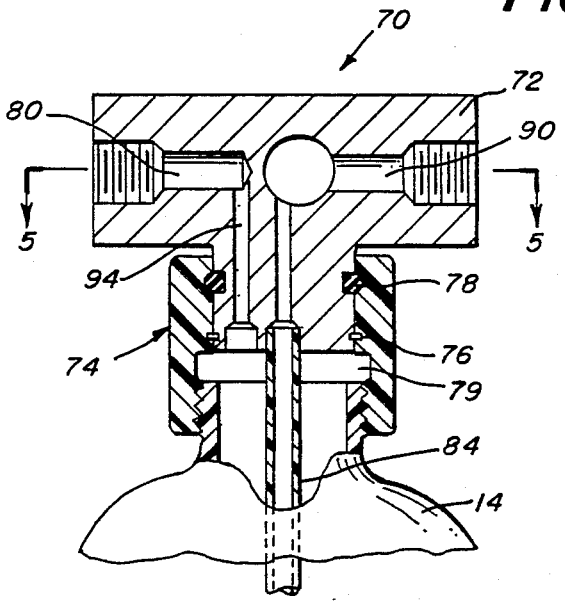
FIG. 4 is a cross-sectional side view through the adapter of FIG. 3 taken along line 4—4 thereof.
Figure 5:
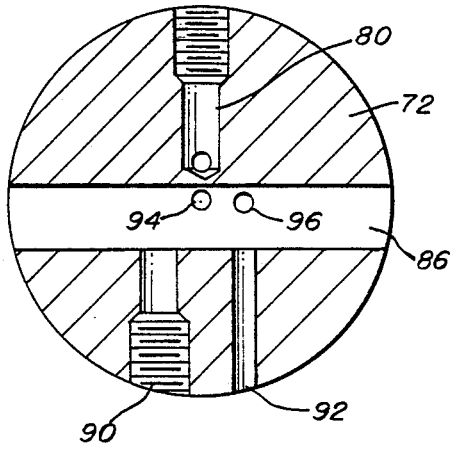
FIG. 5 is a horizontal cross-sectional view taken along line 5—5 of FIG. 4.
Figure 6:
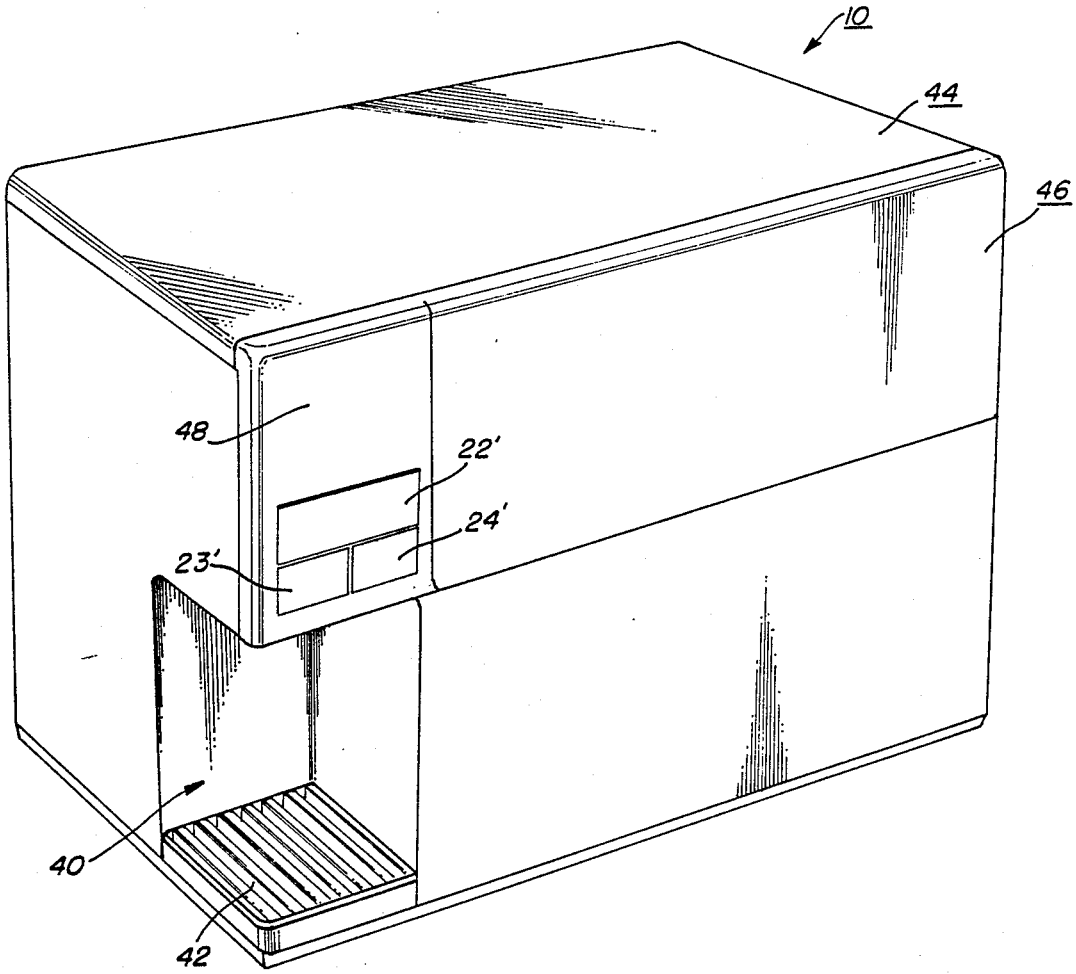
FIG. 6 is a perspective view of the housing of the dispenser of FIG. 1.

With reference now to the drawings, FIGS. 1–8 show a premix dispenser 10 according to one embodiment of the present invention.

The dispenser 10 includes a housing 12; three four-liter PET beverage bottles 14, 15 and 16; a $CO_2$ cylinder 18; a refrigeration system 20; three mechanical beverage dispensing valves 22, 23 and 24 actuated by three buttons 22', 23' and 24' respectively; three nozzles 26, 27 and 28; a $CO_2$ tube 30 from the cylinder 18 to the bottles 14, 15 and 16; three beverage conduits 32, 33 and 34 from the bottles to the refrigeration system; and three valve conduits, two of which (36 and 37) are shown from the refrigeration system to the valves.

The housing is a rectangular box having a beverage dispensing station 40 with the nozzles 26, 27 and 28 and a drip tray 42. Three buttons 22', 23', and 24' are located above the station 40 for actuating the nozzles. The housing includes a top panel 44 and a front panel 46 for providing access to the bottles and the cylinder 18 for replacing empties. A front panel 48 provides access to the valves. The left rear portion of the housing includes a water bath enclosure 50. The housing can be made of any desired material.

Three beverage bottles 14, 15 and 16 are the source of the beverages. Preferably, four-liter PET bottles are used; however, other containers such as two- and three-liter PET bottles can be used.

The $CO_2$ cylinder 18 is preferably a 2.5 pound cylinder with a 55 psi regulator. The $CO_2$ cylinder and regulator can be as described, for example, in U.S. Pat. Nos. 4,357,284 and 4,479,52O.

The refrigeration system 20 as shown in FIGS. 1, 2, 7 and 8 includes a deck 52, adapted to rest on the water bath enclosure 50, a 1/12 hp compressor 54, a condenser 56, three sets of metal, beverage cooling coils 67, 68 and 69, an ice bank control 60, a motor-agitator 62 and a refrigerator coil 58. This is a standard refrigeration system, such as is shown in U.S. Pat. No. 4,493,441, incorporated herein by reference, and thus it need not be shown and described herein in detail. This refrigeration system also includes two handles 64 and 65, which can be used to lift the entire system 20 out of the housing 12. The system 20 can be replaced with a standard cold plate system cooled by ice, for use when electricity is not available. The cooling coils 58 are preferably each 25 feet long. The water enclosure 50 contains fifteen pounds of water. This system can make approximately one pound of ice. When a cold plate system is used, it can hold twenty pounds of ice. Product inlet and outlet quick connects facilitate the easy exchange of one cooling system for the other.

The valves 22, 23 and 24 are standard mechanical valves for premix application. Beverage is dispensed as long as the spring loaded buttons are depressed. Plastic tubing 66 connects each valve to one of the three metal coils in the refrigeration system, similar to the arrangement shown in FIG. 8. Each valve dispenses the beverage through a respective one of the nozzles 26, 27 and 28.

Figure 8:
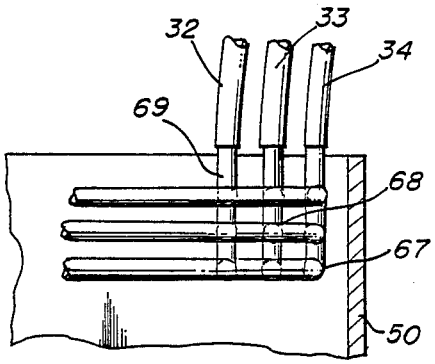
FIG. 8 is a partial side elevational view of the cooling coils and beverage conduits.

The $CO_2$ tube 30 carries $CO_2$ gas to each of the bottles 14, 15 and 16 by a manifold or three-way connector (not shown). The beverage conduits 32, 33 and 34 are connected from the bottles to a respective one of the refrigeration system cooling coils as shown in FIG. 8.

The dispenser 10 includes three adapters 70, each connected to a respective one of the beverage conduits 32, 33 and 34. The adapters 70 are shown in detail in FIGS. 3, 4 and 5 and include a valve body 72 and a coupler ring 74 held to the body 72 by an E-clip 76. The body 72 and coupler 74 are sealed together by an O-ring 78. The coupler ring 74 is internally screw-threaded for attachment to a bottle; a gasket 79 seals the coupler ring 74 to the bottle.

The valve body 72 includes a beverage passageway 90, a fitting (similar to fitting 82) at one end of the passageway 90 for connecting to one of the beverage conduits 32, 33 and 34, and a dip tube 84 at the other end of the passageway for extending down to the bottom of the bottle. The valve body 72 also includes a spool valve chamber 86 for a slidable, two-position. spool valve 88. The body 72 also includes a $CO_2$ gas inlet port 30, a $CO_2$ inlet passageway 94 and $CO_2$ vent passageway 96. In one position, the spool valve opens communication between port 90 and passageway 94 while closing the vent port 92, to pressurize the bottle. In its other position, the spool valve closes communication between the inlet port 90 and inlet passageway 94, while opening communication between the vent port 92 and vent passageway 96, to vent the bottle to atmosphere while preventing loss of $CO_2$ to atmosphere from the cylinder 18.

In operation, when a bottle is empty, it is a simple matter to replace it. The front panel 46 is removed, the spool valve moved to its vent position, the adapter removed from the bottle and connected to a new bottle, and the spool valve returned to its pressurizing position. The $CO_2$ cylinder 18 is adequate for up to about 50 four-liter bottles. It is then easily replaced with a full cylinder.

FIGS. 9–14 show a premix dispenser 100 according to a preferred embodiment of the present invention. The dispenser 100 includes a housing 112; three four-liter PET premix beverage bottles 114, 115, and 116; a $CO_2$ cylinder 118; a refrigeration system 120; three mechanical beverage dispensing valves 122, 123 and 124 actuated by three push buttons 122', 123', and 124', respectively; three nozzles 126, 127 and 128; a $CO_2$ tube 130 from the $CO_2$ cylinder 118 to a manifold 119 and from there to the bottles 114, 115 and 116; three beverage conduits 132, 133 and 134 from the bottles to the refrigeration system; and three valve conduits (of which only two are shown, i.e. 136 and 137) from the refrigeration system to the valves.

The housing 112 is a rectangular box having a beverage dispensing station 140 with the nozzles 126, 127 and 128 and a drip tray 142. Three selector buttons 360, 361 and 362 are located above the station 140 for pushing the buttons 122', 123' and 124'. The housing includes a top panel 364 and a front panel 146 for providing access to the bottles and the cylinder 118 for replacing empties. A front panel 366 provides access to the valves. The left rear portion of the housing includes a water bath enclosure 150. The housing can be made of any desired material. The front panel includes an upper panel 340 hinged to a lower panel 342. The lower panel includes a pair of sidewalls 343 and 344 and a floor (not shown) on which a $CO_2$ bottle fitting 131 is mounted. The floor is connected to a pair of slides 346, whereby the front panel can be slid out from the dispenser. A holder 348 rests on the floor and receives the three bottles and the $CO_2$ cylinder Thus, access to the bottles and $CO_2$ cylinder is easily provided by folding down the upper panel 340 and pulling out entire assembly on the slides 346. One half of each of the slides 346 is connected to the floor of the housing 112 while the movable half of each slide is connected to the floor of the front panel.

Three beverage bottles 114, 115 and 116 are the source of the beverages. Preferably, four-liter PET bottles are used; however, other containers such as two- and three-liter PET bottles can be used.

The $CO_2$ cylinder 118 is preferably a 2.5 pound cylinder with a 55 psi regulator. The $CO_2$ cylinder and regulator can be as described, for example, in U.S. Pat. Nos. 4,357,284 and 4,479,52O.

Figure 7:
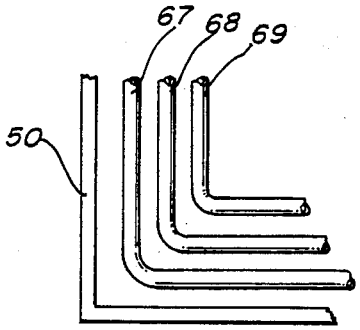
FIG. 7 is a partial top view of the water bath enclosure and the cooling coils of the refrigeration system shown in FIG. 1.
Figure 9:
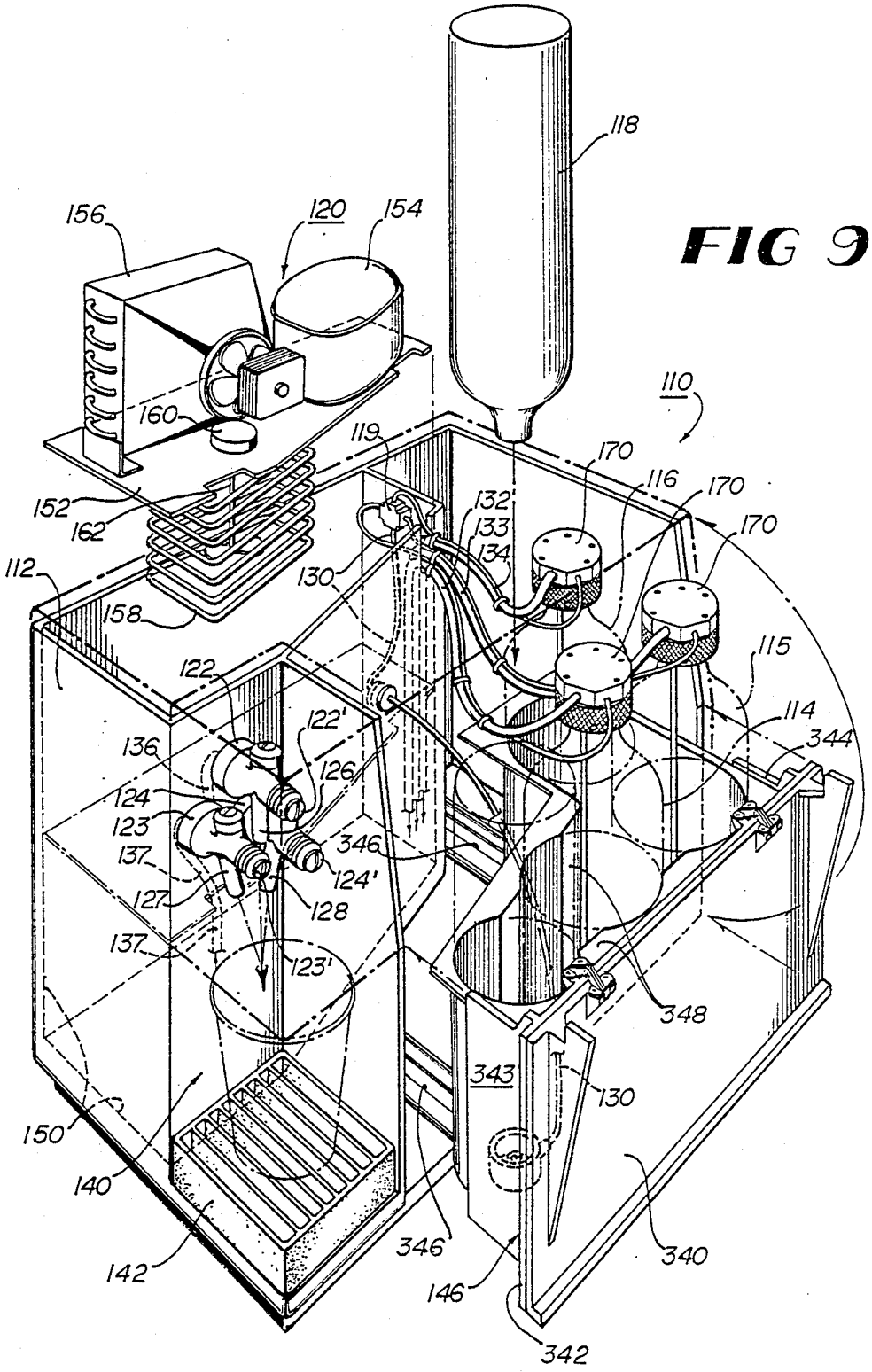
FIG. 9 is a broken-away, perspective view of a premix dispenser according to a preferred embodiment of this invention.
Figure 10:
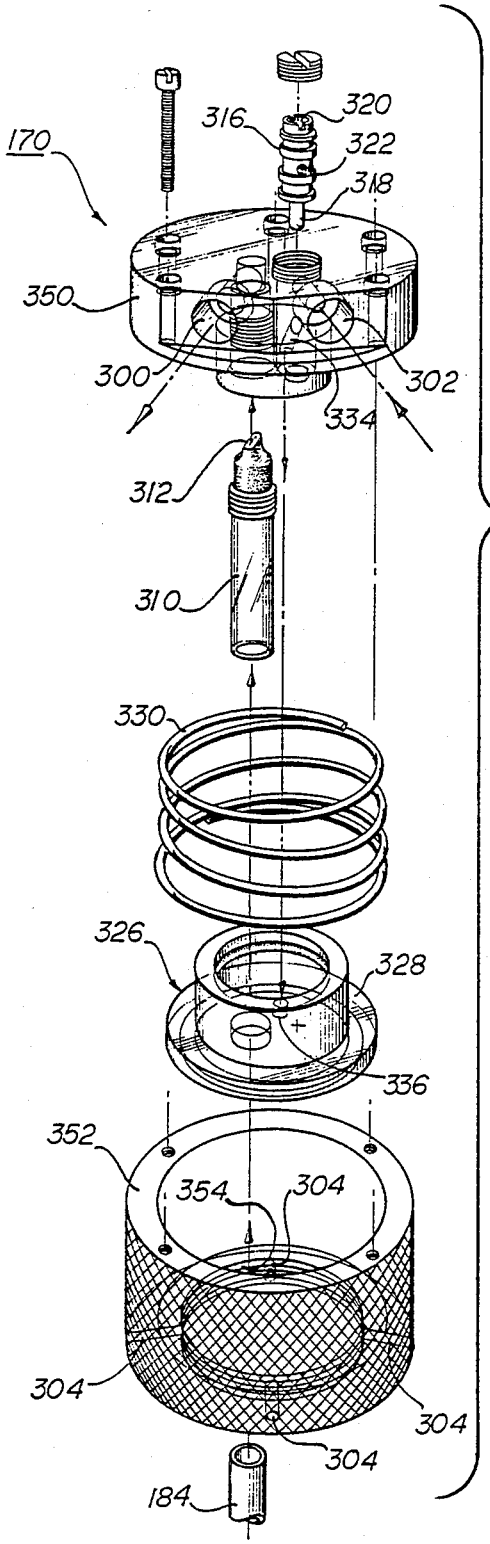
FIG. 10 is an exploded, perspective view of the adapter used in the dispenser of FIG. 9.
Figure 11:
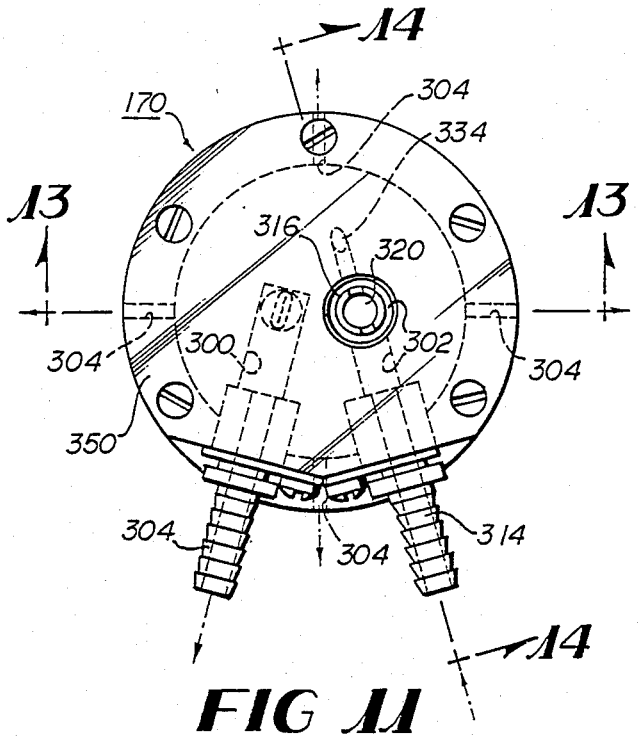
FIG. 11 is a plan view of the adapter of FIG. 10.
Figure 12:
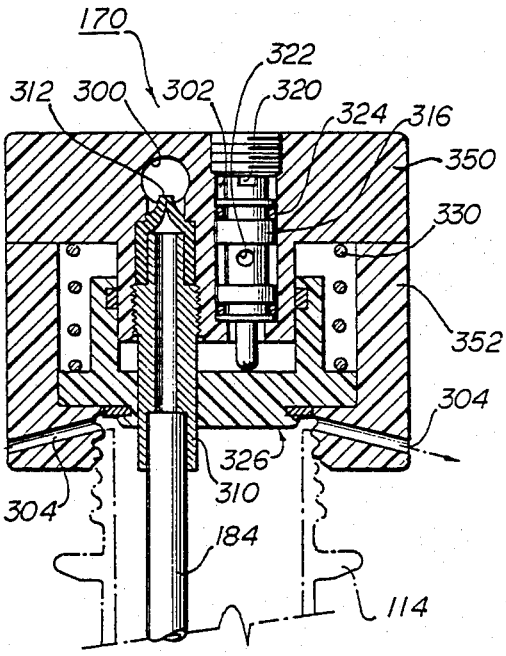
FIG. 12 is a cross-sectional view of the adapter in its closed position taken along line 13—13 of FIG. 11.
Figure 13:
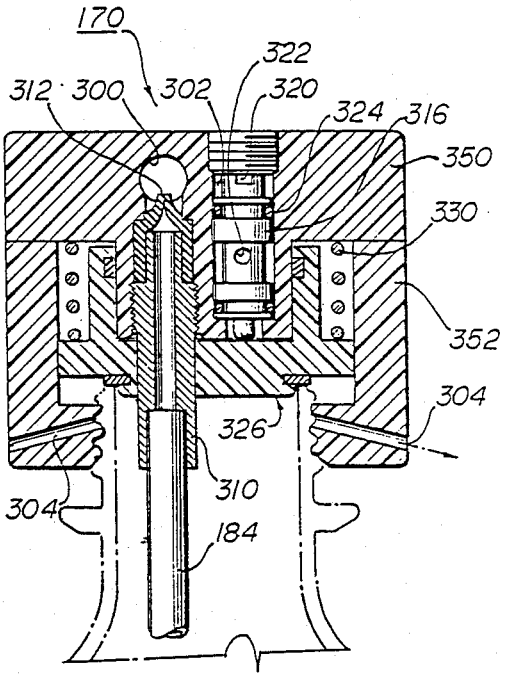
FIG. 13 is a view similar to FIG. 12 but showing the adapter open.
Figure 14:
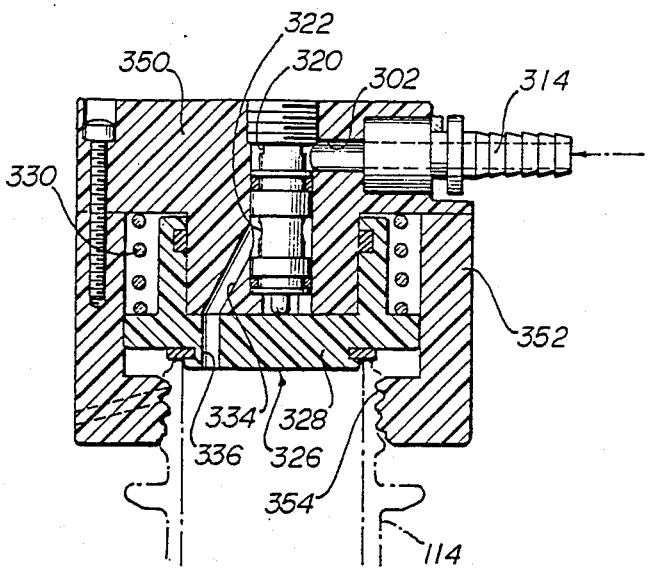
FIG. 14 is a cross-sectional view through the adapter of FIG. 11 taken along line 14—14, and showing the $CO_2$ passage, open.
Figure 15:
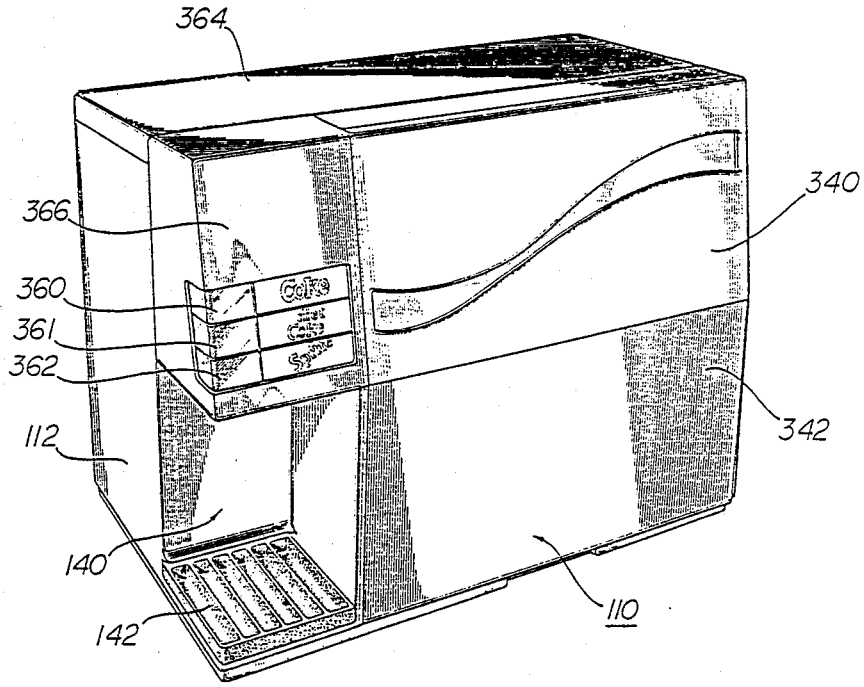
FIG. 15 is a front, top left side perspective of the dispenser of FIG. 9.

The refrigeration system 120 as shown in FIG. 9, includes a deck 152, adapted to rest on the water bath enclosure 150, a 1/12 hp compressor 154, a condenser 156, three sets of metal, beverage cooling coils 67, 68 and 69 as shown in FIGS. 1, 7 and 8, an ice bank control 160, a motor-agitator 162, and a refrigerator coil 158. This is a standard refrigeration system, such as is shown in U.S. Pat. No. 4,493,441, incorporated herein by reference, and thus it need not be shown and described herein in detail. This refrigeration system can include handles for use in lifting the entire system 20 out of the housing 12. The system 120 can be replaced with a standard cold plate system cooled by ice, for use when electricity is not available. The cooling coils 158 are preferably each 25 feet long. The water bath enclosure 150 contains fifteen pounds of water. This system can make approximately one pound of ice. When a cold plate system is used, it can hold twenty pounds of ice. Product inlet and outlet quick connects facilitate the easy exchange of one cooling system for the other.

The valves 122, 123 and 124 are standard mechanical valves for premix application. Beverage is dispensed as long as the spring loaded buttons are depressed. Plastic tubing 66 connects each valve to one of the three metal coils in the refrigeration system, similar to the arrangement shown in FIG. 8. Each valve dispenses the beverage through a respective one of the nozzles 126, 127 and 128.

The $CO_2$ tube 130 carries $CO_2$ gas to each of the bottles 114, 115 and 116 by the manifold 119. The beverage conduits 132, 133 and 134 are connected from the bottles to a respective one of the refrigeration system cooling coils.

The dispenser 110 includes three adapters 170, each connected to a respective one of the beverage conduits 132, 133 and 134. The adapters 170 are shown in detail in FIGS. 10–14.

The adapter 170 includes a beverage passageway 300 with a check valve 312, a $CO_2$ passage 302 with a Schraeder valve 316, a $CO_2$ vent hole 304, and coupling means 306 for connecting the adapter 170 to a bottle.

The beverage passageway 300 includes a fitting 308 to attach to one of the beverage conduits 132, 133 or 134, and a tube 310 extending down into the bottle and into which the top end of a dip tube 184 is inserted. The top end of the tube 310 preferably includes the check valve 312; this check valve can prevent product in the dip tube from leaking out the adapter when the product conduit is disconnected.

The $CO_2$ passage includes a fitting 314 and the Schraeder valve 316. The valve 316 includes a movable valve stem 318 that controls $CO_2$ flow through the valve 312 from an inlet port 320 to an outlet port 322. An O-ring 324 provides a seal between those two ports. The adapter 170 also includes a valve actuator 326. The valve actuator 326 includes a movable plate 328 biased downwardly (as viewed in FIGS. 12–14) by a spring 330, but movable upwardly by the top edge of a bottle as the adapter is screw-threaded thereon. As the bottle moves up into the adapter, the plate 328 contacts the valve stem 318 and eventually opens the $CO_2$ passage 302. The $CO_2$ then can flow through the fitting 314, into port 320, out port 322, through a slanted passage 334, and then through port 336 in the plate 328 and into the bottle. A plug 332 holds the valve 316 in place.

The adapter 170 includes the following venting feature. As the bottle is removed from the adapter 170, the stem 318 moves enough to close the $CO_2$ passage while the screw threads still hold the bottle. Then, as the bottle continues to move down, but while the screw threads continue to hold the bottle, the $CO_2$ vent passage 304 is uncovered allowing the pressure in the bottle to be released, while the bottle is still connected to the adapter 170. Further unscrewing will finally disconnect the bottle from the adapter.

While the adapter can be made in any way and of any desired material, it is preferably made of upper and lower bodies 350 and 352, respectively, held together by screws. The lower body includes the coupling means 306 which are preferably internal screw threads 354. The movable plate 328 includes an opening 356 to accommodate the lower end of the tube 310 into which he dip tube 184 is inserted.

While two embodiments of this invention have been described above in detail, it is to be understood that variations and modifications can be made therein without departing from the spirit and scope of the present invention as set forth in the appended claims. For example, while standard bottles have been shown, especially shaped containers can be used to increase capacity. Also, other numbers and sizes of bottles can be used. The preferred adapter has been shown, but other designs can be used. Other types and locations of valves and nozzles can be used. The preferred pressure has been described, but others can be used, especially if different containers are used.

We claim:

1. A premix dispenser comprising:

(a) a housing;

(b) a refrigeration system mounted in said housing and including a plurality of beverage cooling coils;

(c) a $CO_2$ cylinder;

(d) a plurality of beverage dispensing valves and a plurality of buttons for actuating a respective one of said valves to dispense a beverage;

(e) a plurality of adaptors for connecting to an opening in a respective one of a plurality of premix beverage containers, said containers being completely open to atmosphere through aid openings;

(f) $CO_2$ conduit means connecting said $CO_2$ cylinder to each of said adapters;

(g) a plurality of beverage conduits connected one each between a respective one of said adapters and a respective one of said cooling coils;

(h) a plurality of beverage valve conduits connected one each between a respective one of said cooling coils and a respective one of said valves;

(i) regulator means for controlling the pressure of $CO_2$ applied to said adaptors;

(j) each of said adapters including:

(i) a beverage passageway having an external fitting for connecting to one of said beverage container conduits and having a dip tube for extending down into average container; said beverage passageway including only a check valve therein for preventing beverage from flowing backwards through said passageway and dip tube;

(ii) a $CO_2$ passageway including only a single valve means therein movable between a normally closed first position closing said $CO_2$ passageway, and a second, open position opening said $CO_2$ passageway; and (iii) connecting means for matingly connecting said adapter to a premix beverage container connecting means.

2. The apparatus as recited in claim 1 including three four-liter PET beverage bottles in said housing and connected one each to one of said adapters.

3. The apparatus as recited in claim 1 wherein both of said connecting means are screw threads.

4. A premix dispenser comprising:

(a) a housing;

(b) a refrigeration system mounted in said housing and including a plurality of beverage cooling coils;

(c) a $CO_2$ cylinder;

(d) a plurality of beverage dispensing valves and a plurality of buttons for actuating a respective one of said valves to dispense a beverage;

(e) a plurality of adapters for connecting to a respective one of a plurality of premix beverage containers;

(f) $CO_2$ conduit means connecting said $CO_2$ cylinder to each of said adapters;

(g) a plurality of beverage conduits connected one each between a respective one of said adapters and a respective one of said cooling coils;

(h) a plurality of beverage valve conduits connected one each between a respective one of said cooling coils and a respective one of said valves;

(i) regulator means for controlling the pressure of $CO_2$ applied to said adapters;

(j) each of said adapters including:

(i) a beverage passageway having an external fitting for connecting to one of said beverage container conduits and having a dip tube for extending down into a beverage container;

(ii) a $CO_2$ passageway including valve means therein movable between a normally closed first position closing said $CO_2$ passageway, and a second, open position opening said $CO_2$ passageway; and (iii) said adapter including means for automatically moving said $CO_2$ valve means from said first to said second position when said adapter is connected to as container.

5. The apparatus as recited in claim 4 wherein said adapter includes movable valve actuator means for moving said $CO_2$ valve means.

6. The apparatus as recited in claim 5 including a plurality of premix beverage containers connected one each to a respective one of said adapters.

7. The apparatus as recited in claim 4 wherein said adapter includes $CO_2$ vent means for venting to atmosphere $CO_2$ from a container connected to said adapter, after the container has been disconnected far enough to close said $CO_2$ valve means but not far enough to disconnect the container from said adapter.

8. The apparatus as recited in claim 7 including a plurality of premix beverage containers connected one each to a respective one of said adapters.

9. The apparatus as recited in claim 8 wherein said containers are four-liter PET beverage bottles.

10. The apparatus as recited in claim 3 wherein said vent means is at least one gas passageway through said adapter extending from an inlet port in said screw threads to an outlet port on an outside surface of said adapter.

11. The apparatus as recited in claim 4 including a plurality of premix beverage containers connected one each to a respective one of said adapters.

12. The apparatus as recited in claim 11 wherein said containers are four-liter PET beverage bottles.

13. A method for dispensing any one of a plurality of cold beverages comprising the steps of:

(a) pressurizing a plurality of premix containers with $CO_2$ gas at a pressure of about 55 psi to both dispense beverage therefrom and to maintain their carbonation;

(b) feeding beverage from each of said containers through a respective adapter and a beverage conduit connected to said adapter to a beverage dispensing valve;

(c) cooling the beverage in said conduits; and (d) said pressurizing step comprising connecting a $CO_2$ conduit to said adapter having a normally closed $CO_2$ valve, having coupling means for connecting said adapter to an opening of a beverage container through which opening said container is completely container through which opening said container is completely open to atmosphere, and having valve actuating means for automatically opening said $CO_2$ conduit when said adapter is connected to a container, and connecting said adapter to a container to pressure said container.

14. The method as recited in claim 13 including disconnecting said adapter from said container, including venting the pressure in said container to atmosphere after beginning said disconnecting step but while said adapter is still connected to said container.

* * * * *

UNITED STATES PATENT AND TRADEMARK OFFICE

CERTIFICATE OF CORRECTION

PATENT NO. : 4,836,414

DATED : June 6, 1989

INVENTOR(S) : William S. Credle, Jr. and Jonathan Kirschner

It is certified that error appears in the above-identified patent and that said Letters Patent is hereby corrected as shown below:

Claim 1, line 9, delete "adaptors" and substitute therefor --adapters--.

Claim 1, line 12, delete "aid" and substitute therefor --said--.

Claim 1, line 22, delete "adaptors" and substitute therefor --adapters--.

Claim 1, line 27, delete "average" and substitute therefor --beverage--.

Claim 13, line 11, delete "beverage" and substitute therefor --beverages--.

Claim 13, lines 17-18, delete "container through which opening said container is completely".

Claim 13, line 22, delete "pressure" and substitute therefor --pressurize--.

Signed and Sealed this

Thirty-first Day of July, 1990

*Attest:*

*Attesting Officer*

HARRY F. MANBECK, JR.

*Commissioner of Patents and Trademarks*